US006071106A

United States Patent [19]

Martensen et al.

[11] Patent Number: 6,071,106

[45] Date of Patent: Jun. 6, 2000

[54] HYDRAULIC VANE MACHINE

[75] Inventors: Lars Martensen, Sønderborg; Gunnar Lyshøj Hansen, Nordborg; Henry Madsen Møller, Sønderborg, all of Denmark

[73] Assignee: Danfoss A/S, Nordborg, Denmark

[21] Appl. No.: 09/015,115

[22] Filed: Jan. 29, 1998

[30] Foreign Application Priority Data

Jan. 29, 1997 [DE] Germany ..... 197 03 113

[51] Int. Cl.[7] ..... F01C 19/00

[52] U.S. Cl. ..... 418/140; 418/142; 418/110; 418/259

[58] Field of Search ..... 418/110, 140, 418/142, 259

[56] References Cited

U.S. PATENT DOCUMENTS

| | | | |
|---|---|---|---|
| 3,582,246 | 6/1971 | Traut | 418/259 |
| 4,105,378 | 8/1978 | Hodge | 418/140 |
| 4,376,620 | 3/1983 | Colston | 418/79 |
| 4,823,678 | 4/1989 | Sollami | 92/125 |
| 4,898,524 | 2/1990 | Butzen | 418/140 |

FOREIGN PATENT DOCUMENTS

| | | | |
|---|---|---|---|
| 923657 | 10/1960 | United Kingdom | 418/259 |
| 2325279 | 11/1998 | United Kingdom | 418/110 |
| 98/05864 | 8/1996 | WIPO | 418/259 |

*Primary Examiner*—Thomas Denion
*Assistant Examiner*—Thai-Ba Trieu
*Attorney, Agent, or Firm*—Lee, Mann, Smith, McWilliams, Sweeney & Ohlson

[57] ABSTRACT

Hydraulic vane machine with a rotor having several radially movable vanes, and with a stator having a stator bore, in which the rotor is arranged rotatably, and whose internal wall is made as a guiding contour on which the vanes bear, and with a sideplate arrangement on each axial front side of rotor and stator, which define the vane cells together with the rotor, the vanes and the stator. In such a machine an improvement of the operation behaviour is desired. For this purpose, the sideplate arrangements are fixed on the rotor and rotate together with the rotor in relation to the stator.

13 Claims, 2 Drawing Sheets

IV
VI
V
11
2
17
18
10
18
1
3
25
19
21
20
19
A
V
VI
IV 17
3
28
18
24
25
20
23
27
26
19
4
2
22 a)
26
25
19
20
b)
25
26
19
20
27

HYDRAULIC VANE MACHINE

BACKGROUND OF THE INVENTION

The invention concerns a hydraulic vane machine with a rotor, having several radially movable vanes, with a stator having a stator bore, in which the rotor is arranged rotatably, and whose internal wall is made as a guiding contour on which the vanes bear, and with a sideplate arrangement on each axial front side of rotor and stator, which limit the vane cells together with the rotor, the vanes and the stator.

Such machines can both be made as motors (U.S. Pat. No. 4,376,620 and U.S. Pat. No. 3,254,570) and as pumps (U.S. U.S. Pat. No. 3,255,704). On a rotor rotation in relation to the stator, the vanes move radially inwards and outwards, by which the movement is controlled by the guiding contour. For this purpose the guiding contour has resting areas, in which the stator bore has a diameter only slightly larger than the outside diameter of the rotor, and working areas, in which the stator bore has a larger diameter. Commutation areas are arranged between the resting areas and the working areas, in which the vanes are moved radially from the inside to the outside or from the outside to the inside, respectively. In this connection the bearing of the vanes on the guiding contour is effected by springs. However, in most cases an additional hydraulic support is used to increase the bearing pressure of the vanes on the guiding contour.

Even though the principle, as mentioned above, can be used for both pumps and motors, the following description is, for convenience, based on a motor.

In the working areas the high pressure side of the vanes is admitted with hydraulic fluid under increased pressure. The low pressure side of the vanes is exposed to a lower pressure. The pressure difference across the vanes produces the required torque for the driving of the motor. In some cases it may happen that a closed vane cell is placed between the high pressure and the low pressure connection of the machine. In this case the pressure difference across two or more vanes will apply.

Like in all hydraulic machines it is important that the internal leakages are kept small, i.e. that the machine is also tight inside. In this connection areas, in which sealing between movable parts is required, cause particular problems.

In a vane machine, this is primarily the case with the bearing of the vane on the guiding contour. Additionally, the vane cells must also be sealed towards the side. In the known cases, there is both the friction between the rotor and the sideplates and the friction between the vanes during their radial movement and the side plates. As considerable pressures are applied for the provision of the tightness, each of these movements causes a wear and thus deteriorates the performance, particularly when hydraulic fluids are used, whose lubricating effect is poorer than that of the synthetic hydraulic oils used until now. Such a fluid could e.g. be water.

It is the purpose of the invention to improve the performance of a hydraulic vane machine.

SUMMARY OF THE INVENTION

In a hydraulic vane machine of the kind mentioned in the introduction this task is solved in that the sideplate arrangements are fixed on the rotor and rotate together with the rotor in relation to the stator.

This embodiment does not prevent friction between moving parts. However, at least, different movement kinds are partly isolated from each other. Until now, the rotor with its vanes has rotated in relation to the sideplates. This caused friction between the rotor front surface and the sideplate. In the present embodiment the sideplate now rubs on the stator front surface. However, with the friction of the vanes it is different. Until now the vanes did not only have to make a pure radial movement in relation to the sideplates. This radial movement was also overridden by the rotational movement, so that in principle the vanes had to brush across the whole sideplate surface. An extremely precise manufacturing of the vanes and the sideplates with a corresponding mutual trimming was required to keep the friction at a low level. This is not the case any longer. The vanes are making a purely radial movement in relation to the sideplates, whereas the sideplates make a pure rotation movement in relation to the front side of the stator. This means that these two movements are strictly isolated from each other. Correspondingly, the mutual positioning of the individual parts can be improved, so that a better tightness is achieved. An overridden movement of the vanes in relation to the stator will occur. However, this movement is restricted to a smaller area, so that it is no longer so critical. In total, these design measures lead to a somewhat reduced wear, which again gives an improved operation of the machine. Particularly with the motor the reduced friction also gives an improved starting torque or a better starting behaviour.

In a preferred embodiment each sideplate arrangement has an inner plate and an outer plate, by which a hydraulic pressure pocket arrangement is formed between inner and outer plate. By means of the pressure pocket arrangement pressure forces acting in the axial direction can be exerted on stator and rotor by the sideplate arrangement. While the sealing forces for the rotor could also be achieved through a fixing with mechanical fixing links, this is more difficult with the contact surface to the stator. However, the hydraulic forces which can be produced in the pressure pocket arrangement are sufficient to provide a sealing also in this area. Here the outer plate can be used as abutment, on which the pressure in the pressure pockets is "supported", to press the inner plate against rotor and stator.

In this case it is particularly preferred for the pressure pocket arrangement to have at least one pressure pocket connected with each vane cell. When the vane cell is exposed to pressure, such a permanent connection provides that the same pressure will also rule in the pressure pocket. On the other hand it is also provided that the pressure in the pressure pocket drops, when there is no pressure in the vane cell. Correspondingly, the sealing forces are only built up when required. In the unloaded vane cells sealing forces are not required. Therefore a sealing force is not produced here, and the wear is kept small.

Preferably, the pressure pocket has a larger pressure surface than the vane cell in the axial direction. Irrespective of the size of the pressure in the vane cell, this measure provides that the contact force of the sideplate on the stator is larger than the force attempting to lift the sideplate from the stator due to the pressure in the vane cell. This measure is relatively simple. However, it ensures the tightness of the machine.

Advantageously each pressure pocket has a sealing. This reduces the requirement on accuracy when working the inner and outer plates. The tightness is no longer only provided by the bearing of these two plates against each other. The tightness is supported by the sealing.

In this connection it is particularly preferred that the sealing is made by means of a sealing ring arranged between inner and outer plate in the pressure pocket under pretension. Such a sealing ring, e.g. made as round cord sealing ring or O-ring is non-expensive and easy to fix.

It is particularly preferred that the inner plate has a recess, in whose area the sealing ring does not bear on the inner plate in the axial direction. This measure provides that the hydraulic fluid under pressure can also reach an area between inner plate and sealing ring. In this way, penetration in one spot is sufficient. Then the hydraulic fluid successively lifts the sealing ring from the inner plate and presses it against the outer plate. Thus the total surface of the pressure pocket is available for absorption of the hydraulic forces and production of the corresponding forces, and not only the space surrounded by the sealing ring. The arrangement can therefore also be used when only a limited room is available.

In an alternative embodiment the sealing can also be made as a diaphragm connected with the inner plate. The diaphragm is pressed against the outer plate through a pressure admission of the pressure pocket, and thus produces the required contact forces. The diaphragm can e.g. be sprayed on the inner plate, when a synthetic coating is available here.

Preferably, a small gap is arranged in the area of the pressure pockets between inner and outer plate. As stated above, the inner plate and the outer plate must no longer be precisely adapted to each other. It may even be contemplated to leave a small gap between them on purpose. The width of the gap is in the range between a few hundredth and 3/10 mm. It is no problem to seal such a small gap with the sealing ring or the diaphragm, and a disadvantageous deformation of the sealing will not occur. However, the gap involves the advantage that a possible unilateral loading of the outer plate can be compensated. Such a unilateral loading leads to a, though small, inclination of the outer plate in relation to the inner plate. Without the gap this would cause an admission of the inner plate by the outer plate pressing the inner plate with a larger force against the stator, causing an increased wear. Initially, this can be caught by the gap, as the gap permits a small inclination of the outer plate in relation to the inner plate. Further, the gap simplifies the fixing. The torque required for tightening the bolts keeping rotor and sideplate arrangement together must not be exactly the same for all bolts. However, it can be higher than without the gap, as drawing together the sideplates will not immediately cause a bearing on the rotor.

Advantageously, the inner plate is provided with a friction reducing synthetic material, at least on the area bearing on the stator. Such a synthetic material performs a low-friction co-operation with the material of the stator, e.g. stainless steel. Particularly suited are synthetic materials from the group of high-strength thermoplastic synthetic materials on the basis of polyaryl ether ketones. These materials could be e.g. polyether ether ketones, polyamides, polyacetalene, polyaryl ether, polyethylene terephthalate, polyvinylene sulphide, polysulphones, polyether sulphones, polyether imides, polyamid imides, polyacrylates, phenolic resins, such as novolack resin etc., by which glass, graphite, polytetra flourethylene or carbon, especially in fibre form, can be used as fillers. In this connection, especially the material polyether ether ketone (PEEK) has proved to be useful. When using such materials, also water can be used as hydraulic fluid.

In a preferred embodiment a channel connected with the low pressure connection is provided between the inner plate and the rotor, which channel runs next to the vane cells and the moving areas of the vanes. In spite of all precautions, it can normally not be prevented that hydraulic fluid reaches areas, in which it is not wanted. Even though it is only a question of small quantities, such a leakage during operation can lead to a pressure build-up corresponding to the operation pressure of the hydraulic machine. When the leaking hydraulic fluid reaches the area between rotor and sideplate, it must be provided that this hydraulic fluid does not cause a separation of the sideplates, which would lead to further leakage. This is the reason for providing the channel. In the radial direction it limits as large an area as possible around the centre of the rotor. Of course the size is limited on one side by the vane cells and on the other side by the moving areas of the vanes, also having hydraulic areas, which contribute to the moving control of the vanes. In any case, the channel helps providing that the area lying radially inside the channel is kept pressure-free. Any hydraulic fluid reaching the channel cannot move further inwards, but is drained off to the low pressure connection through the channel. Thus the fixing means keeping the sideplates and the rotor together in the axial direction, e.g. bolts, can be kept relatively small, thus simplifying the dimensioning.

Advantageously, the in- and outlet of hydraulic fluid takes place from the radial direction. This means that the sideplate arrangements are free of control tasks. They no longer have to perform a real commutation of the hydraulic fluid. They must only provide that the vane cells remain tight. This is a considerable simplification of the machine design.

Preferably, the supply connections for inlet and outlet are arranged in the guiding contour. In other words, both the pump connection and the tank connection or the high pressure connection and the low pressure connection, respectively, run into the inner wall of the stator bore. The commutation then happens automatically on passing of the vanes. These are then supplied with the corresponding pressures in the right position.

Preferably, the guiding contour has working and resting sections, between which the commutation sections are arranged, by which the beginning and end of each commutation section has a supply connection with the same direction. The commutation areas or sections are the only sections in which the vanes move. With the arrangement of a supply connection both in the beginning and in the end of each commutation area, both connections having the same direction, it is provided that the vanes are not loaded with a pressure difference on retraction and extension into or from the rotor. Thus, e.g. two pump or high pressure connections can be provided on the ends of the commutation section, into which the vanes extend. Correspondingly, two tank connections or low pressure connections are provided on the ends of the commutation section, into which the vanes retract. The fact that the vanes are not loaded with a pressure difference on extension and retraction causes that they are not either pressed against the rotor. The friction between rotor and vanes is thus kept as low as possible in the commutation sections. This also reduces the wear and improves the performance.

BRIEF DESCRIPTION OF THE DRAWINGS

In the following the invention is described on the basis of a preferred embodiment in connection with the drawings, showing.

DETAILED DESCRIPTION OF THE INVENTION

Figure 1:
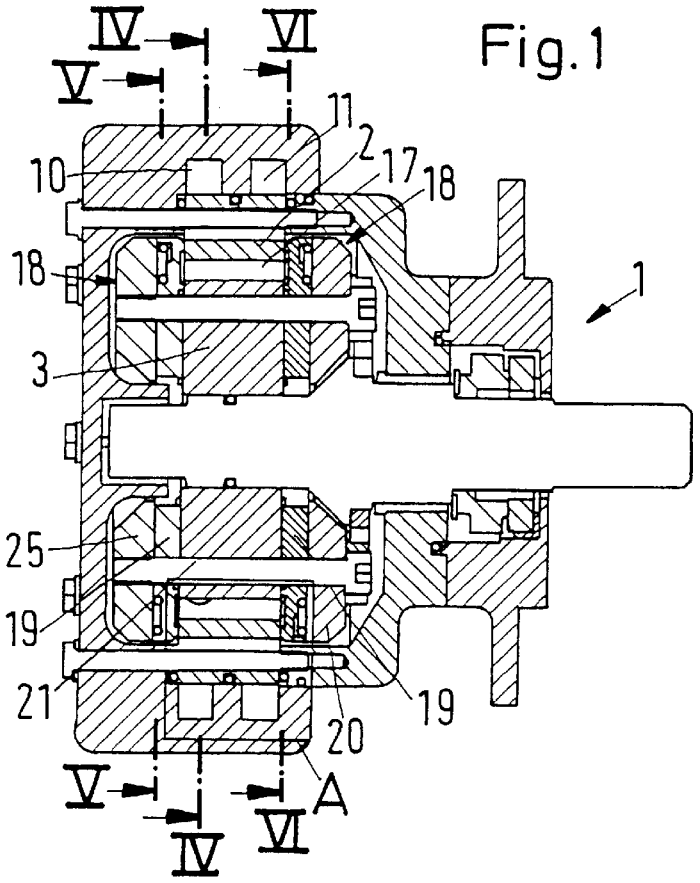
FIG. 1 a longitudinal section through a hydraulic vane motor

A vane motor 1 has a stator 2 in which a rotor 3 is rotatably arranged. The stator has a stator bore, whose inner wall creates a guiding contour 4. The guiding contour 4 has two diametrically opposed resting sections 5, in which the stator bore diameter is only slightly larger than the rotor, and also two diametrically opposed working sections 6, in which the stator bore diameter is larger. Transition or commutation areas 7, 7*a* are arranged between the resting sections 5 and the working sections 6.

The rotor 3 has several, in this case eight, vanes 8, which are pressed radially outwards and thus against the guiding contour 4 by means of a spring 9.

Figure 4:
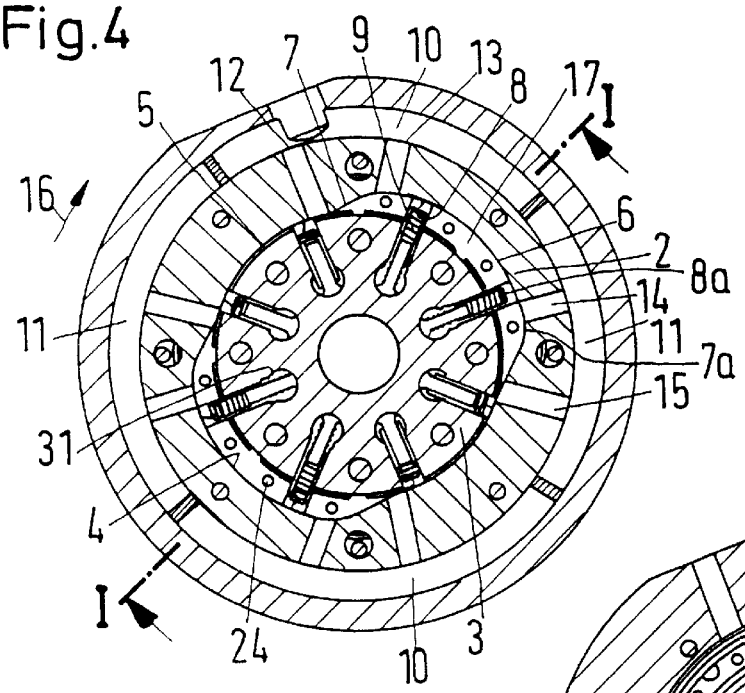
FIG. 4 a section IV—IV according to FIG. 1

The principal mode of operation of such a motor 1 can be explained on the basis of FIG. 4. Pump channels 10 and tank channels 11 are provided in the stator. For reasons of clarity, FIG. 4 shows the pump channels 10 and the tank channels on the same level. In fact, however, as shown in FIG. 1, they are placed on levels displaced axially in relation to each other.

As the design of the machine is rotation symmetrical, only one working section 6 is explained in the following.

The pump channel 10 is connected with the stator bore via two pump bores 12, 13 arranged at the beginning and the end of the commutation section 7, i.e. the pump bores 12, 13 run into the guiding contour 4. The tank channel 11 is also connected with the stator bore via tank bores 14, 15, i.e. also the tank bores 14, 15 run into the guiding contour 4 at the beginning and the end of the commutation section 7*a* following the commutation section 7.

When the rotor 3 rotates in the direction of the arrow 16, one vane 8 first passes the pump bore 12. As hydraulic fluid is also supplied through the pump bore 13 with the same pressure, the vane 8 is exposed to the same pressure on both sides in the rotation direction. Thus it can extend under the force of the spring 9, without being pressed against the rotor by hydraulic pressures. If required, the force of the spring 9 can also be supported by hydraulic pressures (not shown).

As soon as the vane 8 has passed the second pump bore 13, hydraulic fluid is only supplied on its high pressure side. The high pressure side is the rear side in the movement direction. As soon as the preceding pump vane 8*a* has passed the tank bore 14, the hydraulic fluid on the low pressure side of the vane 8 flows into the tank bore. This causes a pressure difference between the two sides of the vane 8, which produces the torque required to drive the rotor 3.

Also in the following commutation section 7*a* the vane 8 is exposed to the same pressure on both sides, viz. the tank pressure. Consequently it is not loaded by a pressure difference of the hydraulic fluid, when it is retracted into the rotor 3 through the effect of the guiding contour 4.

Vane cells 17 are formed between the individual cells. From FIG. 4 can be seen that these vane cells are limited by the rotor 3 and the stator 2 (in the radial direction) and by neighbouring vanes 8, 8*a* in the circumferential direction. From FIG. 1 it appears that for the sealing of the vane cells 17 in the axial direction sideplate arrangements 18 are provided on both axial front sides of rotor 3 and stator 2. These sideplate arrangements 18 limit the vane cells 17 in the axial direction.

The sideplate arrangements 18 comprise an inner plate 19 and an outer plate 20. The two sideplate arrangements 18 and the rotor 3 are fixed to each other by means of bolts 21, i.e. the sideplate arrangements 18 rotate together with the rotor 3 in relation to the stator 2.

As the sideplate arrangements 18 rotate together with the rotor 3, the vanes 8 can always be retracted and extended in the same place in relation to the sideplates. A friction in the rotation direction occurs in areas 22 between the inner plate 19 and the stator 2. To produce the required tightness here, the inner plate 19 must be pressed against the stator 2 with a certain force. This force is produced by means of a hydraulic pressure pocket 23 connected via a channel 24 with the vane cell 17. The cross section area of the pressure pocket 23 in the axial direction is larger than the cross section area of the vane cell 17 in the same direction. Correspondingly, the force working axially from the outside to the inside is larger than the force working axially from the inside to the outside. The inner plate 19 is thus pressed against the stator 2 with a positive force.

The contact force only appears, when hydraulic fluid under pressure is available in the vane cell 17. However, a sealing will only be needed in this case. When the corresponding vane cell 17 is in a resting section 5, a contact force is not produced. But it is not required either, as there is no hydraulic fluid, for which sealing is required.

At least in the area 22 the inner plate 19 has a surface with a friction reducing synthetic material, e.g. polyether etherketone (PEEK). In many cases, however, it will be advantageous to cover the whole inner plate 19 with the synthetic material, or even to make it of this synthetic material, by which reinforcements of stainless steel may be provided.

The outer plate 20 is made of a more stable material, e.g. of stainless steel. This combination of materials also permits the use of water as hydraulic fluid.

Between the inner plate 19 and the outer plate 20, at least in the area of the pressure pockets 23 there is a small gap 25. This gap 25 can have a width ranging from a few hundredth to approx. 3/10 mm. It serves the purpose of compensating possible tilts of the outer plate 20 in relation to the inner plate 19, i.e. to prevent that a possible tilt, which might e.g. occur through an uneven loading of the outer plate 20, would cause a correspondingly higher contact force of the inner plate 19 against the stator. It also facilitates the fitting. The bolts can be tightened with a relatively high torque, which must however not be uniform, by which the risk of a jamming of the stator is normally rather small.

Figure 3:
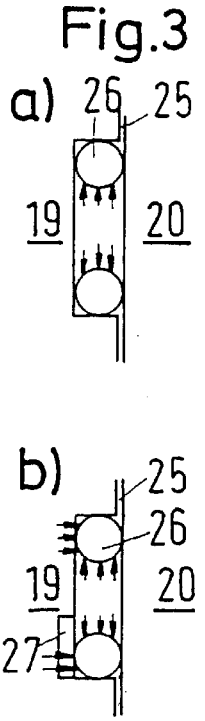
FIG. 3 a schematic view of a sealing arrangement

To seal this gap 25 (and of course to seal the pressure pocket 23 towards the outside), a sealing in the shape of a sealing ring 26 is provided, which is made as a round cord sealing ring or O-ring. This sealing ring bears on both inner plate 19 and outer plate 20 under a certain pretension (compression). An additional feature is, however, that the sealing ring 26 does not bear on the inner plate 19 throughout its whole length. A recess 27 is provided, in whose area the sealing ring 26 has a small distance from the inner plate 19. In this recess 27 the hydraulic fluid entering the pressure pocket 23 can now get under the sealing ring 26. The hydraulic fluid can then propagate throughout the length of the sealing ring 26, thus pressing the sealing ring 26 axially against the outer plate 20. This increases the effective section of the pressure pocket 23. This appears from FIG. 3 showing a schematic view of the mode of operation.

FIG. 3*a* shows the embodiment without the recess 27. Here the hydraulic fluid could only influence the sealing ring 26 in the radial direction, as shown schematically by means of arrows. This will also provide a certain sealing, as the sealing ring 26 is deformed and seals the gap 25. However, practically only the area within the sealing ring 26 is available for a pressure admission on the inner plate 19.

When, as shown in FIG. 3*b*, the hydraulic fluid can also get under the sealing ring 26 through the recess 27, it presses the sealing ring 26 against the plate 20 also in the axial direction, so that a larger pressure application surface will be available due to the corresponding counter-pressure on the inner plate 19. Besides, the tightness is improved.

Alternatively, the sealing of the pressure pocket 23 can also be made in a way not shown, in that each pressure pocket has a diaphragm, made in one piece with the inner plate 19. This embodiment is especially advantageous, when the inner plate 19 has a coating of a synthetic material. In this case the diaphragm can be made together with the synthetic material coating.

Figure 5:
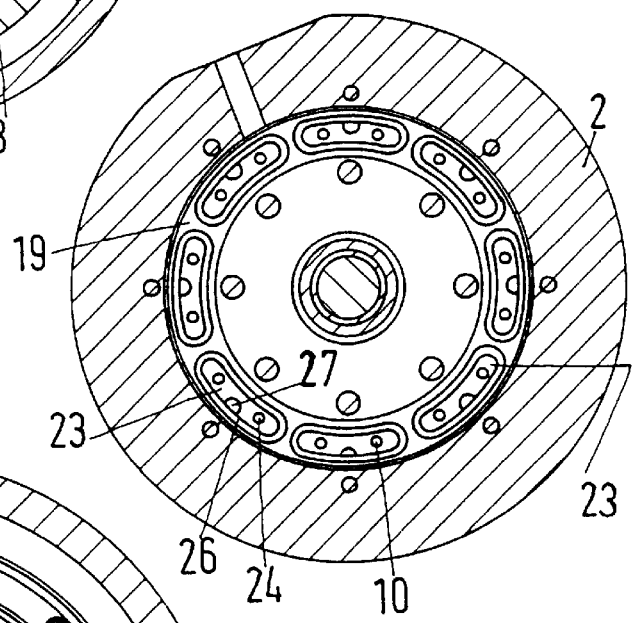
FIG. 5 a section V—V according to FIG. 1
Figure 6:
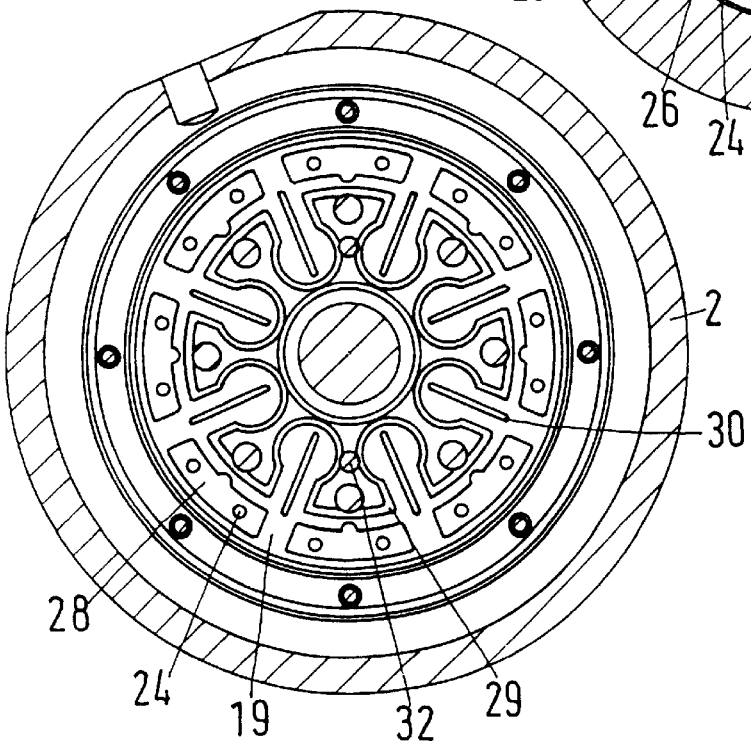
FIG. 6 a section VI—VI according to FIG. 1

FIG. 5 shows the side of the inner plate 19, on which the pressure pockets 23 are arranged. FIG. 6 shows the opposite side of the inner plate 19.

Figure 2:
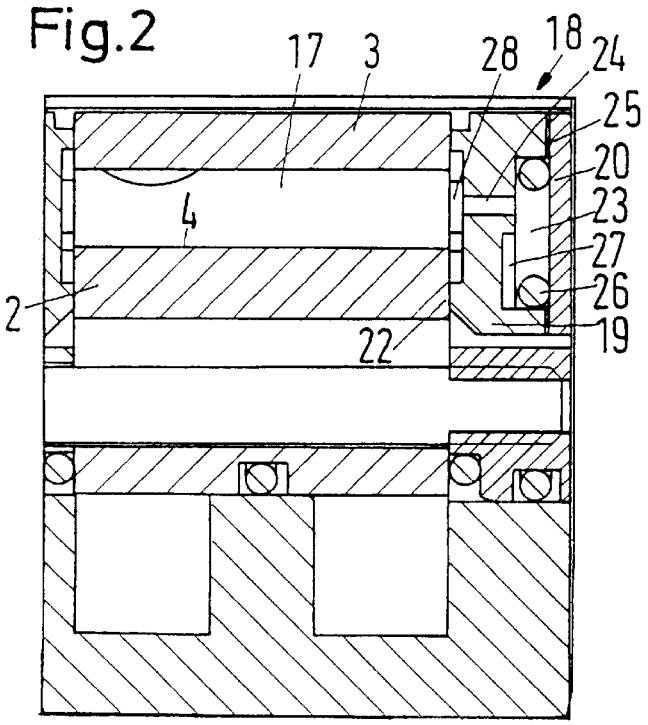
FIG. 2 a detail enlargement A according to FIG. 1

FIGS. 2 and 6 show that in the area of the vane cells 17 the inner plate 19 has pockets 28. By means of these pockets it is possible to reach a balance between the hydraulic forces on the axial inside and the axial outside of the inner plate 19. This is particularly important in the commutation areas 7, 7*a*, as here the section of the vane cells 17 changes. However, the pockets 28 secure that a constant pressure surface is available.

On the inside of the inner plate 19 shown in FIG. 6 a channel 29 is provided, following the vane cells, or rather the pressure pockets 28, closely. Further, it surrounds the moving area of the vanes 8, here shown as a radial groove 30. Among other things, this radial groove 30 can also be used for transporting hydraulic fluid to the basis 30 of the vanes 8 to intensify the hydraulic pressure to the outside. Further, this radial groove 30 can also be used for a hydraulic relief of the vanes 8 on movements in the radial direction, which leads to a friction reduction.

The purpose of the channel 29 is the draining of hydraulic fluid reaching the inside between the rotor and the side plate arrangements 18 (in the radial direction) in spite of all sealing efforts. This provides a chamber in the area radially inside the channel 29, on which the pressure of the hydraulic fluid is not admitted. Correspondingly, the bolts 21 can be kept so small that they fit in between the individual cells for the vanes 8.

When the inner plate 19 has a coating of a synthetic material or is made of a synthetic material, all channels shown in FIGS. 5 and 6 can be made when moulding the plate, simply by providing a corresponding negative mould.

What is claimed is:

1. A hydraulic vane machine comprising a rotor having several radially movable vanes, a stator having a stator bore in which the rotor is arranged rotatably, the stator having an internal wall comprising a guiding contour on which the vanes bear, and a sideplate arrangement on each axial front side of the rotor and the stator, which together with the rotor, the vanes and the stator form vane cells, the sideplate arrangements being fixed on the rotor and rotating together with the rotor in relation to the stator, each sideplate arrangement including an inner plate and an outer plate adjoining the inner plate, and a hydraulic pressure pocket arrangement being formed between the inner and outer plates.

2. The machine according to claim 1, in which the pressure pocket arrangement has at least one pressure pocket connected with each vane cell.

3. The machine according to claim 2, in which the pressure pocket has a larger pressure surface than the vane cell in the axial direction.

4. The machine according to claim 2, in which each pressure pocket has a seal.

5. The machine according to claim 4, in which the seal comprises a sealing ring located between the inner and outer plates in the pressure pocket under pretension.

6. The machine according to claim 5, in which the inner plate includes a recess, and the sealing ring does not bear on the inner plate in the axial direction in the recess.

7. The machine according to claim 4, in which the seal comprises a diaphragm connected to the inner plate.

8. The machine according to claim 4, in which a small gap is located in the pressure pockets between the inner and the outer plates.

9. The machine according to claim 1, in which the inner plate includes a friction reducing synthetic material at least on an area bearing on the stator.

10. The machine according to claim 1, in which a channel connected with a low pressure connection is between the inner plate and the rotor, the channel extending next to the vane cells and moving areas of the vanes.

11. The machine according to claim 1, in which an in- and outlet of hydraulic fluid takes place from the radial direction.

12. The machine according to claim 11, in which supply connections for inlet and outlet are located in the guiding contour.

13. The machine according to claim 11, in which the guiding contour has working and resting sections between which the commutation sections are located, each commutation section having a supply connection at a beginning and an end of the commutation section.

* * * * *